US005501748A

United States Patent [19]

Gjestland et al.

[11] Patent Number: 5,501,748

[45] Date of Patent: Mar. 26, 1996

[54] PROCEDURE FOR THE PRODUCTION OF THIXOTROPIC MAGNESIUM ALLOYS

[75] Inventors: Haavard Gjestland; Hakon Westengen, both of Porsgrunn, Norway

[73] Assignee: Norsk Hydro A.S., Oslo, Norway

[21] Appl. No.: 74,659

[22] Filed: Jun. 10, 1993

[30] Foreign Application Priority Data

Jun. 10, 1992 [NO] Norway ..... 922266

[51] Int. Cl.[6] ..... C22F 1/06

[52] U.S. Cl. ..... 148/538; 148/666; 148/667; 148/420; 420/402; 420/407; 420/408; 420/409; 420/410; 420/411; 420/405; 420/406

[58] Field of Search ..... 148/538, 666, 148/667, 420; 420/402, 406, 405, 407, 408, 409, 410, 411, 590; 75/600; 164/900, 80

[56] References Cited

U.S. PATENT DOCUMENTS

| | | | |
|---|---|---|---|
| 2,976,143 | 3/1961 | Sturkey et al. | 420/407 |
| 3,902,544 | 9/1975 | Flemmings et al. | 164/71 |
| 4,116,423 | 9/1978 | Bennett | 266/200 |
| 5,143,564 | 9/1992 | Gruzleski et al. | 148/420 |
| 5,147,603 | 9/1992 | Nussbaum et al. | 420/409 |

FOREIGN PATENT DOCUMENTS

| | | | |
|---|---|---|---|
| 784445 | 10/1957 | United Kingdom | 420/407 |

*Primary Examiner*—David L. Lacey
*Assistant Examiner*—Sean Vincent
*Attorney, Agent, or Firm*—Wenderoth, Lind & Ponack

[57] ABSTRACT

Procedure for the production of a thixotropic magnesium alloy by adding a grain refiner combined with controlled, rapid solidification with subsequent heating to the two-phase area. It is preferable to use a solidification rate of >1° C./s, more preferably >10° C./s. It is essential that the solidification takes place at such a speed that growth of dendrites is avoided. Heating to the two-phase area is carried out rapidly in 1–30 minutes, preferably 2–5 minutes. By heating an alloy comprising 2–8 weight % Zn, 1.5–5 weight % RE, 0.2–0.8 weight Zr balanced with magnesium to a temperature in the two-phase area after casting, the structure will assume a form in which the α-phase is globular (RE=rare earth metal). The size of the spheres will be dependent on the temperature and the holding time at that temperature and they will be surrounded by a low-smelting matrix. It is preferable that the alloy has a grain size of not greater than <100 μm, more preferably 50–100 μm. A grain-refined magnesium alloy comprising 6–12 weight % A1, 0–4 weight % Zn and 0–0.3 weight % Mn also assumes thixotropic properties when heated to the two-phase area. Grain refiners such as Zr or carbon-based agents such as, for example, wax/fluorspar/carbon powder or calcium cyanamide can be used, depending on the alloy.

9 Claims, 4 Drawing Sheets

PROCEDURE FOR THE PRODUCTION OF THIXOTROPIC MAGNESIUM ALLOYS

Figure 1A:
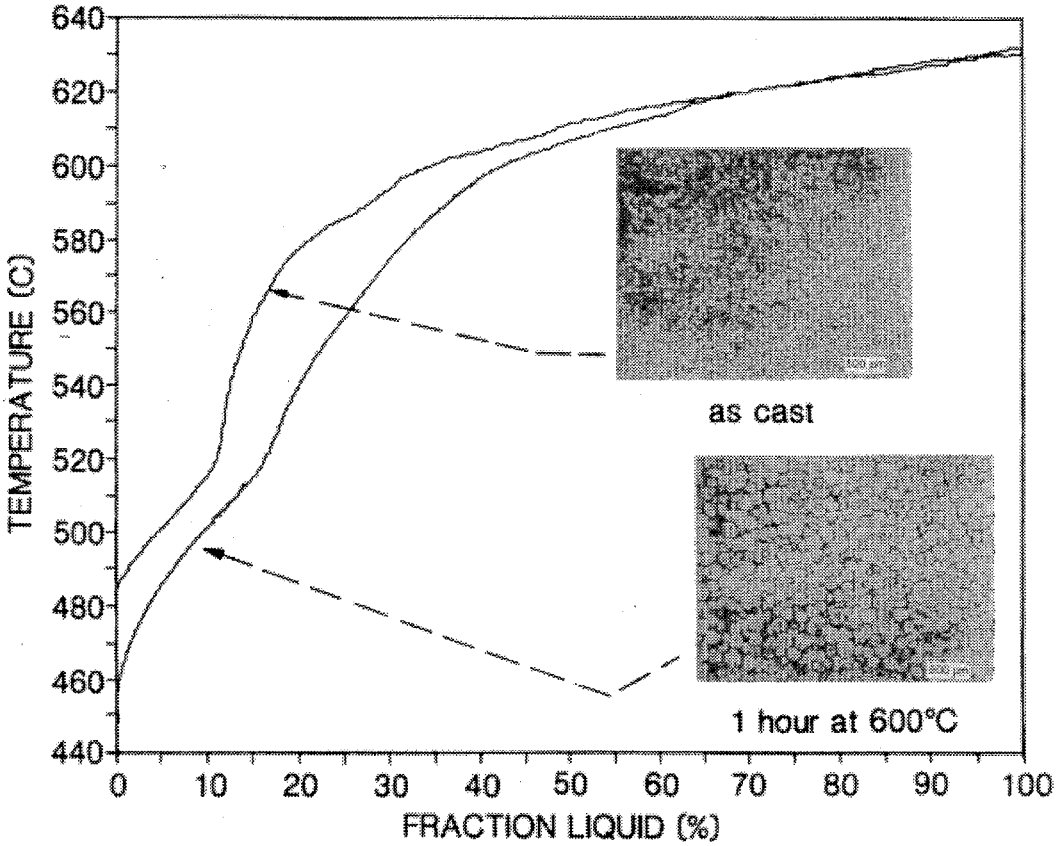

The present invention concerns a procedure for the production of thixotropic magnesium alloys.

The characteristic feature of thixotropic materials is that under mechanical shear stress they flow like a viscous liquid such as, for example, paint or clay. Metal alloys which are heated to a temperature in the two-phase region, where typically 50 volume % is melted, may, under certain circumstances, behave thixotropically. For this to occur, the melt must be allowed to flow freely. This makes demands on the microstructure.

The structure of a cast alloy is usually composed of an a-phase in the form of dendrites with a low-melting eutectic between the dendrites and the dendrite arms. When this structure is heated to a temperature in the two-phase region, the eutectic melts and the α-phase is coarsened. However, under mechanical shear stress the eutectic will not be able to move freely because of the dendrite network and the result will be what is called hot tearing in the material.

The structure can be influenced in various ways so that the α-phase takes on a globular form instead of a dendritic form. The eutectic will thus be continuous throughout the material and in the partly melted condition in the two-phase region, it will be allowed to move freely when the material is exposed to mechanical shear stress. The material is then said to have thixotropic properties.

All known patented methods for producing thixotropic materials are based on mechanical or inductive electromagnetic agitation in the melt during solidification or a combination of deformation and recrystallisation. U.S. Pat. No. 4,116,423 describes a procedure for producing thixotropic magnesium by means of mechanical agitation. The method is simple, but requires relatively advanced equipment. It is only suitable for repeated casting of elements. Strict requirements are set for the cooling rates in the agitation zone and the agitation will create a great deal of wear on the equipment. The particle size is large with diameters of 100–400 μm.

When producing thixotropic alloys by means of recrystallisation and partial melting, the material is hot worked like extrusion, forging, drawing or rolling.. During heat treatment to the partially melted state, the structure will recrystallise into an extremely fine-grained and non-dendritic structure. Such a process is very comprehensive with many stages. Such a process is, for example, described in Malachi P. Kuneday et al., "Semi-Solid Metal Casting and Forging", Metals Handbook, 9th edition, Vol. 15 p.327.

Procedures also exist for grain-refining magnesium alloys by either heating them way above liquidus temperature or by adding a grain refiner such as carbon or zirconium. Better mechanical properties are achieved with a smaller grain size.

The object of the present invention is to obtain a direct process for the production of thixotropic magnesium alloys. Another object is thus to achieve a thixotropic structure by means of direct casting. It is also an object of the present invention to obtain a magnesium alloy with thixotropic properties.

A low temperature in the casting material can give a higher casting speed because there is less heat of fusion to extract. A lower temperature in the material will result in less thermically induced erosion in the casting mould. Mould filling will be more laminar which results in less entrapped gas. This will contribute to less porosity and allow heat treatment of the cast parts.

These and other objects of the present invention are achieved with the product and the procedure described below and the invention is described in more detail and characterised in the enclosed claims.

It was surprisingly found that by adding a grain refiner to a magnesium alloy combined with rapid solidification with subsequent heating to the two-phase region, a thixotropic magnesium alloy was obtained. It is preferred to use a solidification rate >1° C./s, more preferably >10° C./s. It is essential that the solidification is carried out rapidly to avoid growth of dendrites. The heating to the two-phase region should be carried out in 1–30 minutes, preferably 2–5 minutes. A magnesium alloy comprising 2–8 weight % Zn, 1.5–5 weight % rare earth metal (RE) and 0.2–0.8 weight % Zr as grain refiner will by heating to the two-phase region after casting, show thixotropic properties. This will result in a microstructure where the a-phase is globular with a grain size in the range 10–50 μm. The size of the spheres will be dependent on the temperature and holding time and they will be surrounded by a low melting matrix. Also an equiaxial grain structure of this alloy, with grain size 50–100 μm and a secondary dendrite arm space of 5–30 μm will behave thixotropically. In the Zr-grain refined alloys the RE/Zn ratio will influence the structure. With a high ratio, RE/Zn >1, the globular structures tend to develop. Small ratios give more equiaxial structures which transform into spheres during heating to the two-phase region.

A grain refined magnesium alloy comprising 6–12 weight % Al, 0–4 weight % Zn, 0–0.3 weight % Mn will also obtain thixotropic properties after heating to the two-phase region. For these alloys carbon based grain refiners are used, preferably wax/fluorspar/carbon powder or calcium cyanamide. The alloy will have an equiaxial structure with a grain size not greater than <100 μm, preferably 50–100 μm and with a secondary dendrite arm space 5m.

Figure 1B:
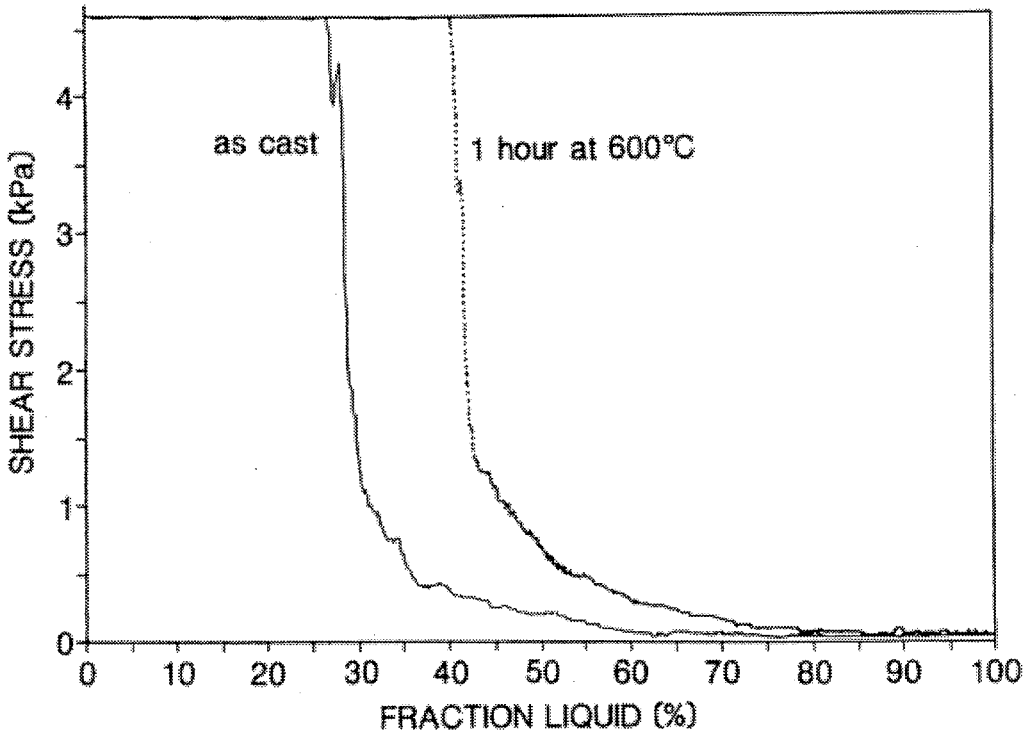

The present invention will be described in more detail with reference to the enclosed FIGS. 1–6, in which FIGS. 1*a* and 1*b* show the temperature and shear stress deformation as well as the microstructure as a function of fraction liquid for ingots with composition 5.0% Zn, 1.5 RE, 0.55 Zr and the rest magnesium, as cast and the ingots kept at 600° C. for 1 hour.

Figure 2A:
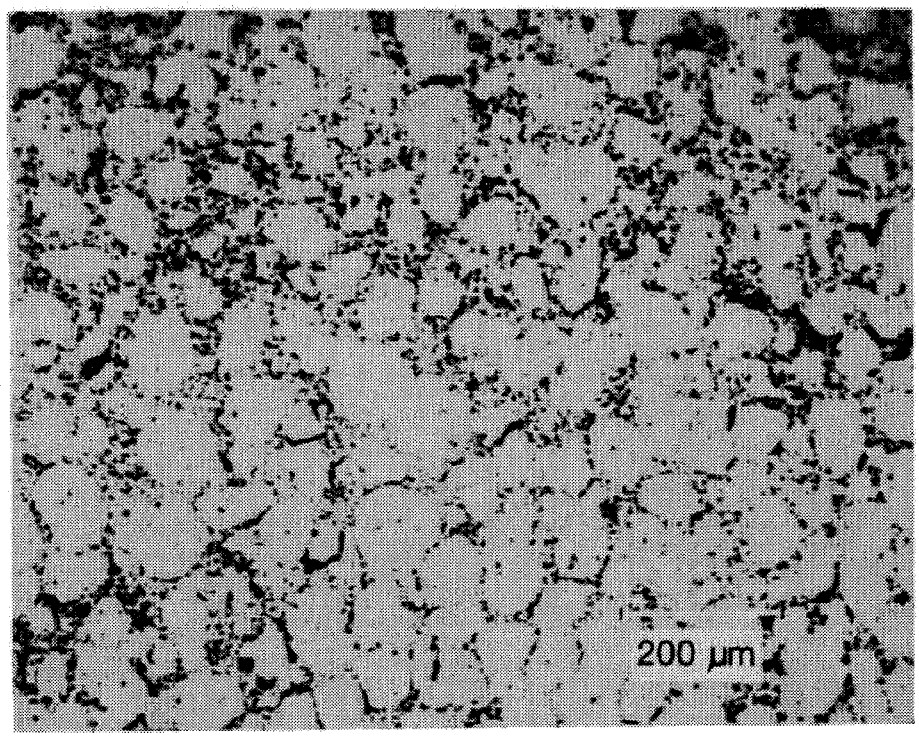
Figure 2B:
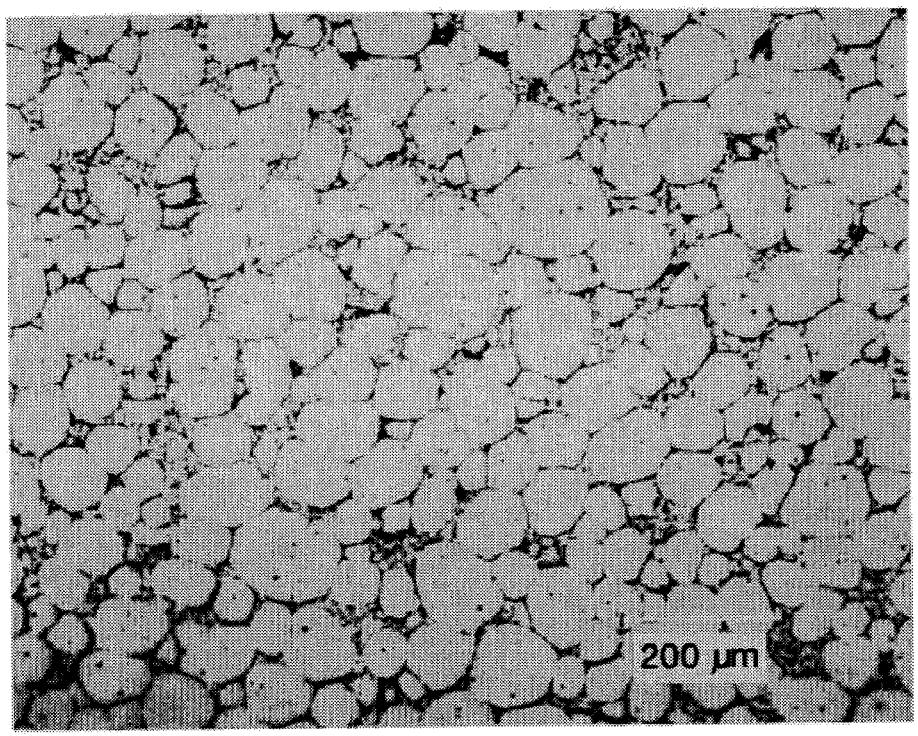

FIGS. 2*a* and 2*b* show microphotographs of a magnesium alloy with composition 5.0% Zn, 1.5% RE, 0.55% Zr balanced with magnesium cast with piston speeds a) 0.5 m/s og b) 1.2 m/s.

Figure 3A:
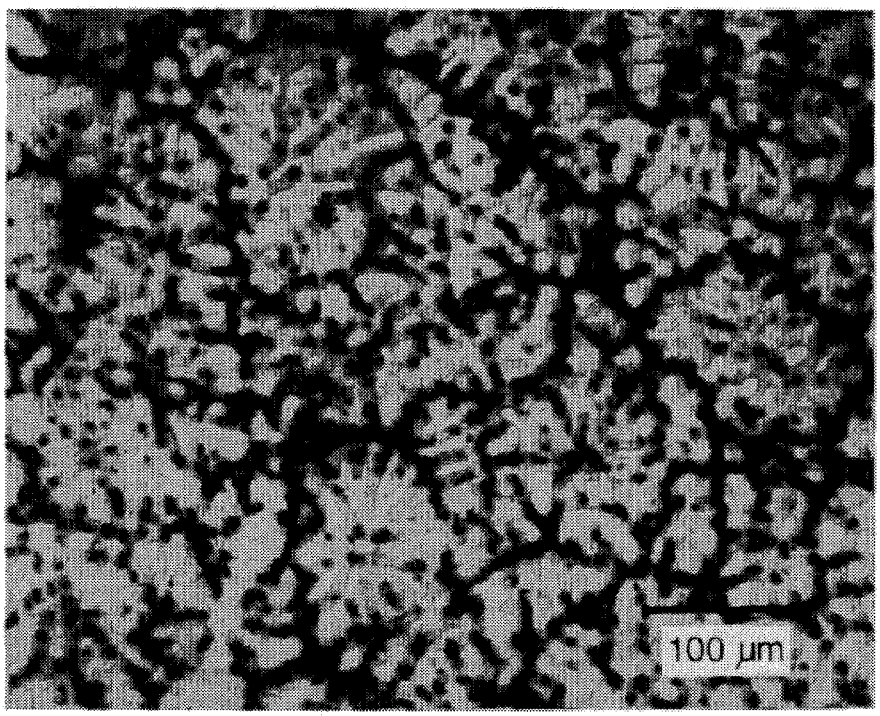
Figure 3B:
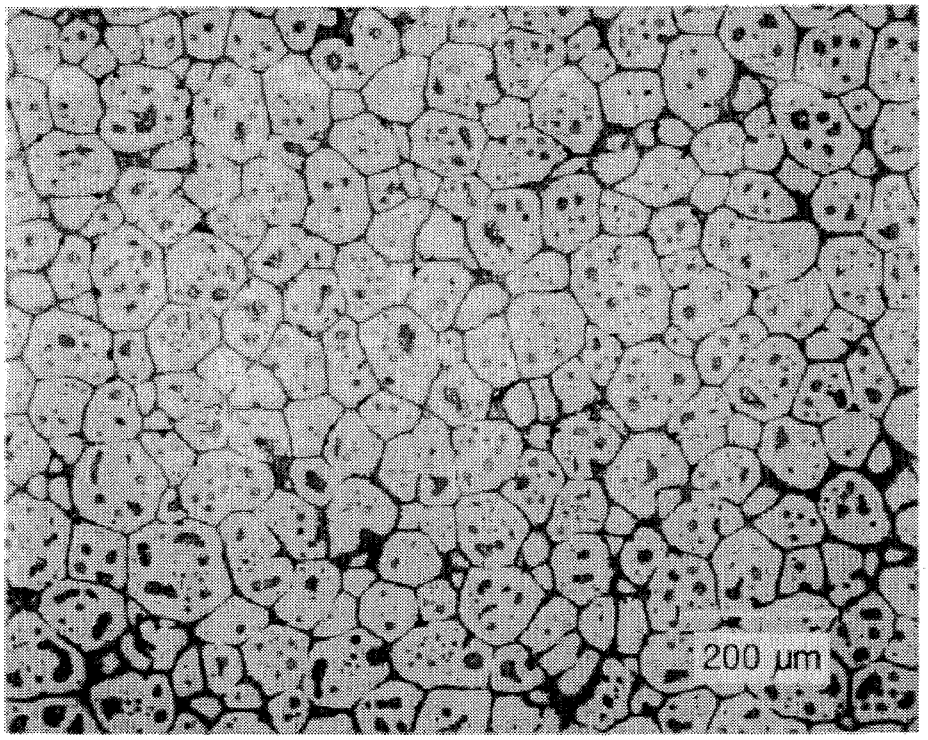

FIGS. 3*a* shows an equiaxial structure of grain-refined AZ91 (1% Zn) as cast. FIG. 3*b* shows AZ91 as cast and heated up to 575° C. in 15 minutes and water quenched.

FIG. 4 shows rheological properties for a dendritic and a thixotropic AZ91 magnesium alloy when heated from a solid to a semi-solid state.

Figure 5A:
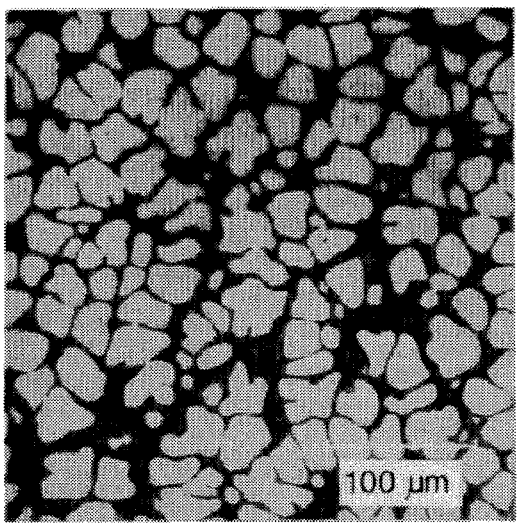
Figure 5B:
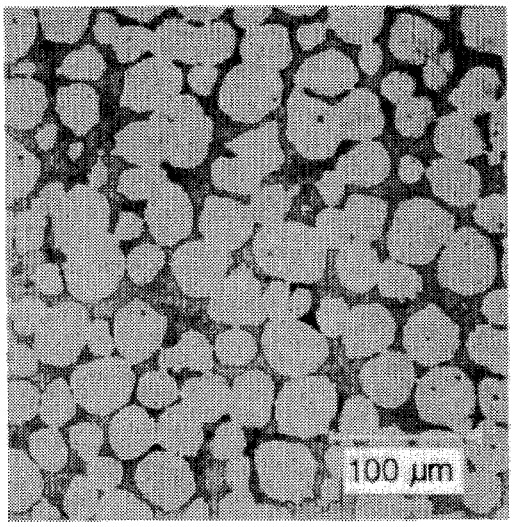

FIGS. 5*a* and 5*b* show microstructure in the a) as cast and b) heated condition for a magnesium alloy comprising 2% Zn, 8% RE, 0.55Zr.

Figure 6A:
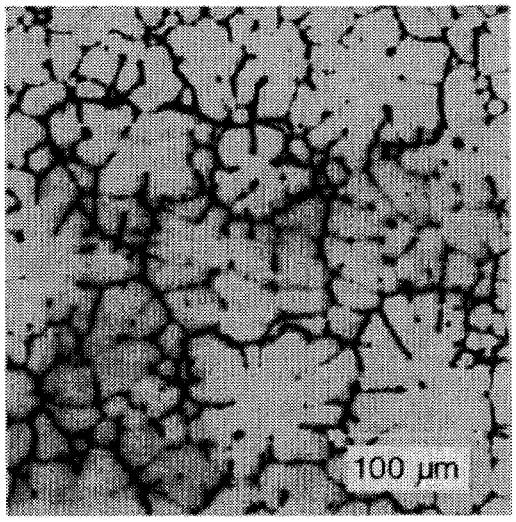
Figure 6B:
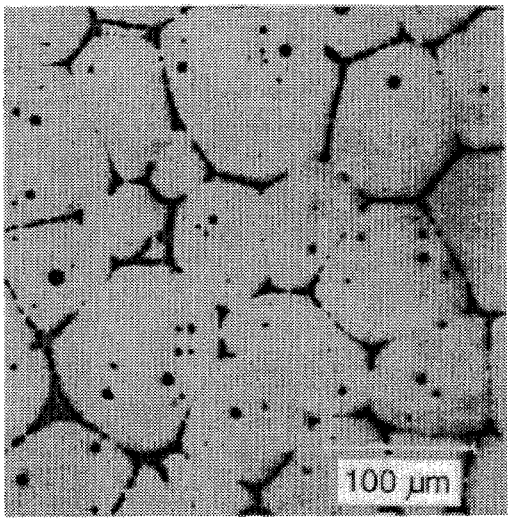

FIGS. 6*a* and 6*b* show microstructure in the a) as cast and b) heated condition for a magnesium alloy comprising 5% Zn, 2% RE, 0.55 Zr.

Preliminary tests were carried out in which it was found that the microstructure of the ingots were dependent on the solidification rate. Rapid cooling produced a structure which was non-dendritic, whereas slower cooling produced a coarser structure which was more dendritic. It was found to be necessary to solidify the alloys at a speed >1° C./s, preferably >10° C. to obtain a thixotropic structure by means of subsequent heating to the two-phase region.

The invention will be illustrated and further described in the examples. Different magnesium alloys can be treated to behave thixotropically. In the examples two different types of alloys are used. Magnesium alloys comprising 2–8 weight % Zn, 1.5–5 weight % rare earth metal (RE) were grain refined with 0.2–0.8 weight % Zr. These alloys can also contain small amounts of other alloying elements. For magnesium alloys containing aluminium, carbon based grain refiners are used. A preferred magnesium alloy comprises 6–12 weight % Al, 0–4 weight % Zn and 0–0.3 weight % Mn. It may also contain small amounts of other alloying elements.

EXAMPLE 1

An alloy with a thixotropic microstructure will change its properties from solid to liquid by heating to the two-phase region. If a little pressure is applied to the material, this transition can be defined when the material starts to deform. This transition has been characterised by rheological and thermal measurements in a laboratory test.

Ingots of an alloy with composition 5.0% Zn, 1.5% RE, 0.55% Zr and the rest magnesium (ZE52), diameter 50 mm and length 150 mm were cast. The cast ingots were isothermically heat treated at 600° C. for different times and subsequently cooled by quenching. FIG. 1 shows the microstructure for ZE52 for ingots as cast and for ingots heated to 600° C. for 180 s and kept at that temperature for 1 hour. The figure shows that the equiaxial structure in the sample as cast is changed to a globular structure when heated to a semi-solid state and becomes coarser after heat treatment. The microstructure shown for heat treated material can be regarded as being almost globular particles suspended in a liquid. The particle size is about 40 μm as cast and 100 μm after heat treatment.

Rheological measurements were also carried out on structures as shown in FIG. 1. The heating time was 10 min. for all samples. The graph of shear stress (viscosity) as a function of the liquid fraction shows that the transition from solid to liquid form takes place at a higher fraction liquid with coarser grain size. The transition from solid to liquid form can be defined as the yield point when the shear stress begins to decrease from the maximum Tm=4.59 kPa, as shown in the figure. The test shows that the rheological properties of the alloy are dependent on the microstructure. A structure with small uniform grains demonstrates a thixotropic state with a lower liquid fraction than a heat treated and coarser structure.

EXAMPLE 2

Casting tests were carried out in an industrial vertical squeeze casting machine. An alloy with composition 5.0% Zn, 1.5% RE, 0.55% Zr balanced with magnesium was used. Ingots with diameter 60 mm and a length of 150 mm were cast. The thixotropic parameters are stated in table 1.

TABLE 1

| No. | Alloy | Bar temperature [°C.] | Piston speed [m/s] |
|---|---|---|---|
| 1 | ZE52 | 600 | 1.2 |
| 2 | ZE52 | 600 | 0.5 |
| 3 | ZE52 | 605 | 0.5 |
| 4 | ZE52 | 605 | 1.0 |
| 5 | ZE52 | 610 | 1.2 |
| 6 | ZE52 | 610 | 0.5 |

The ingots were heated in a resistance furnace. Thermocouples were placed in the ingots during heating. The workpieces were transferred to the casting cylinder when they had reached the required temperature without any soaking time. The heating time was approximately 40 minutes for all tests. They still had a consistency which made it possible to transport them from the furnace to the injection unit of the casting machine. The piston speeds used correspond to an injection speed of 2.8–6.7 m/s for the component which was cast. The structure was studied in the castings. FIG. 2 shows micrographs taken at the same postion in component a) at piston speeds of 0.5 m/s and b) at 1.2 m/s. From the micrographs it is possible to see that a high casting speed produces a better defined grain. There is also a tendency towards microporosity in the cast parts where a low casting speed has been used.

EXAMPLE 3

Samples were cast of an AZ91 magnesium alloy with composition 9.1% A1, 0.92% Zn, 0.3% Mn and the rest magnesium, grain-refined with calcium cyanamide. In a small furnace of diameter 60 mm, pieces of the alloy (20×20×20) $mm^3$ were heated to the two-phase region and subsequently cooled by quenching. The structure was studied. FIG. 3*a*) shows the equiaxial structure of the grain-refined AZ91 as cast. As can be seen from the figure, the grain structure is equiaxial with a grain size 100 μm. The secondary dendrite arm spacing (DAS) is 5–30 μm. FIG. 3*b*) shows the AZ91 as cast and heated to 575° C. in 15 minutes and then cooled by quenching. The figure shows that when heated to the two-phase region, the alloy develops a thixotropic structure with globular α-Mg in an eutectic matrix. The particle size was 50–70 μm.

EXAMPLE 4

The rheological properties were studied for AZ91 magnesium alloys with and without the addition of grain refiners. A mixture of wax/fluorspar/carbon was used as a grain refiner. FIG. 4 shows the rheological properties for a dendritic and a thixotropic AZ91 magnesium alloy when heated from a solid to a semi-solid state. The figure shows that the thixotropic microstructure changes its rheological properties with a liquid fraction of 52%. The corresponding transition does not take place with the dendritic structure (without grain refiner) with a liquid fraction of less than approximately 92%.

EXAMPLE 5

Tensile tests have been carried out on two different alloys to determine the mechanical properties of these alloys.

An alloy system based on additions of zinc and rare earths to magnesium and grain refined with zirconium, has been used. Table 2 shows the chemical composition in weight % of two test alloys.

TABLE 2

| Alloy | Zn | RE | Zr |
|---|---|---|---|
| ZE 52 | 5.1 | 2.00 | 0.48 |
| ZE 55 | 5.2 | 4.65 | 0.40 |

Ingots were permanent mould cast in steel tubes with diameter 60 mm and length of 150 mm as in example 2. The tubes were water quenched giving a solidification rate of 20–40° C./s. The ingots were heated for 30 minutes before loading into the injection unit of the casting machine. As the volume fraction of liquid was less than 50%, the ingots could be handeled as solid. Mould temperature was 300° C., injection pressure 800 MPa and injection speed 1.2 m/s.

Tensile test bars were machined from the cast products. The tensile tests were carried out according to standard procedure for magnesium. In table 3 tensile yield strength, tensile strength and elongation of the thixotropic alloys investigated are shown.

TABLE 3

| Alloy | $R_{p\,0.2}$ [MPa] | $R_m$ [MPa] | A [%] |
|---|---|---|---|
| ZE 52 | 100 | 170 | 4.3 |
| ZE 55 | 125 | 160 | 2.0 |

Mechanical properties of conventional cast alloys are shown in Table 4.

TABLE 4

| Alloy | $R_{p\,0.2}$ | $R_m$ | A |
|---|---|---|---|
| EZ 33 T5 | 100 | 140 | 3.0 |
| ZE 41 T5 | 135 | 215 | 4.0 |

Comparing the values with values for conventional cast alloys of similar composition, reveals that the mechanical properties of these thixotropic castings are in the same range.

EXAMPLE 6

Ingots of an alloy with composition of 2% Zn, 8% RE, 0.55% Zr and the rest magnesium (ZE28), diameter 50 mm and a length of 150 mm were cast. The ingots were heated to 595° C. in 15 minutes and subsequently cooled by quencing. FIG. 5 shows the microstructures in the as cast and heated condition. The casting of ingots results in a globular structure which does not change much during the heat treatment. The size of the spheres are 30–50 μm.

EXAMPLE 7

Ingots of an alloy with composition 5% Zn, 2% RE, 0.55 Zr and the rest magnesium (ZE52), diameter 50 mm and a length of 150 mm were cast. The ingots were heated to 595° C. in 15 minutes and subsequently cooled by quenching. FIG. 6 shows the microstructure in the as cast and heat treated condition. The casting of ingots results in an equiaxial structure with a grain size of <100 μm and a secondary dendrite armspacing of 5–30 μm. During the heat treating this structure transform into a sperical structure of size around 100 μm.

With this invention we have obtained a simple and direct method of producing thixotropic magnesium alloys. The grain refined alloy treated in the described way will by heating to the two-phase region behave thixotropically. Casting can be carried out at a high speed and with laminar mould filling. The products also have good mechanical properties.

We claim:

1. A method for production of a thixotropic magnesium alloy, which consists essentially of adding a grain refiner to a molten magnesium alloy, rapidly cooling the alloy to solid state, and subsequently heating the alloy to its two-phase region.

2. The method in accordance with claim 1, wherein the alloy is cooled at a cooling rate greater than 1° C./s.

3. The method in accordance with claim 2, wherein the alloy is cooled at a cooling rate greater than 10° C./s.

4. The method in accordance with claim 1, wherein the heating from solid state to the two-phase region is carried out in 1–30 minutes.

5. The method in accordance with claim 4, wherein the heating to the two-phase region is carried out in 2–5 minutes.

6. The method in accordance with claim 1, in which said molten magnesium alloy consists essentially of magnesium, 6–12 weight % Al, 0–4 weight % Zn, 0–0.3 weight % Mn and a carbon-based grain refiner.

7. The method in accordance with claim 6, wherein the grain refiner is a mixture of wax, fluorspar and carbon powder.

8. The method in accordance with claim 6, wherein the grain refiner is calcium cyanamide.

9. The method in accordance with claim 1, in which said molten magnesium alloy consists essentially of magnesium, 2–8 weight % Zn, 1.5–5 weight % RE and 0.2–0.8 weight % Zr as grain refiner.

* * * * *